United States Patent [19]

Yang

[11] 3,949,204

[45] Apr. 6, 1976

[54] DETENT MECHANISM FOR MECHANICAL COUNTER HAVING PARTITION MEMBER

[75] Inventor: Chun-Wei Yang, Taipei, China /Taiwan

[73] Assignee: General Instrument Corporation, Clifton, N.J.

[22] Filed: Jan. 27, 1975

[21] Appl. No.: 543,981

[52] U.S. Cl. ..... 235/103; 235/117 R

[51] Int. Cl.[2] ..... G06C 27/00

[58] Field of Search ... 235/103, 112, 117 A, 139 A, 235/1 A; 116/124.1

[56] References Cited

UNITED STATES PATENTS

| | | | |
|---|---|---|---|
| 2,304,516 | 12/1942 | White | 235/139 R |
| 2,636,680 | 4/1953 | Summers | 235/131 FD |
| 3,317,133 | 5/1967 | Fox | 235/131 FD |
| 3,557,746 | 1/1971 | Jungblut | 235/103 |
| 3,708,114 | 1/1973 | Johnson | 235/103 |

FOREIGN PATENTS OR APPLICATIONS

| | | | |
|---|---|---|---|
| 320,014 | 10/1929 | United Kingdom | 235/139 R |

*Primary Examiner*—L. T. Hix
*Assistant Examiner*—Vit W. Miska

[57] ABSTRACT

A counter includes a housing, a mask having an opening therein defining a viewing station and units and tens counter wheels coaxially aligned and rotatably mounted on the housing in alignment with the viewing station. Means are provided for operably connecting the counter wheels to drive the tens wheel in accordance with the rotation of the units wheel. A detent wheel is mounted on the hub of the units wheel for movement therewith. A partition member is situated between the counter wheels and spring means mounted on the partition member cooperate with the detent wheel to position the units wheel relative to the viewing station after each rotation thereof. The spring means includes a base member and a pair of leg members one of which extends from each end of the base member to form a U-shape configuration. The leg members are bent to form a pair of protrusions which are spaced to receive the detent wheel therebetween. A mounting member is connected to the base member and is provided with a pair of mounting arms which are bendable to form a space into which the partition member extends.

18 Claims, 8 Drawing Figures

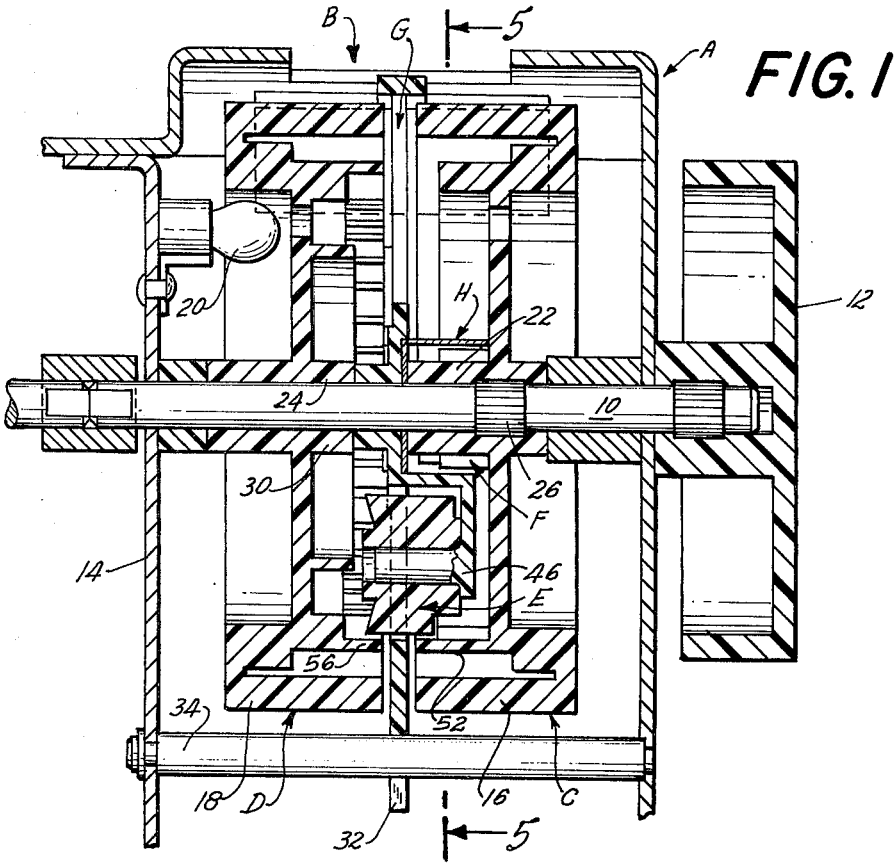
FIG. 1
FIG. 3a
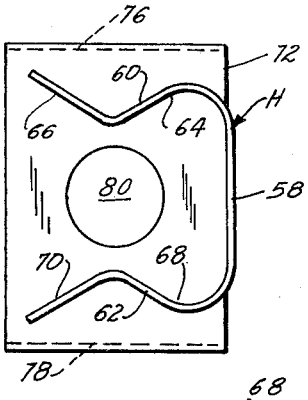
FIG. 3b
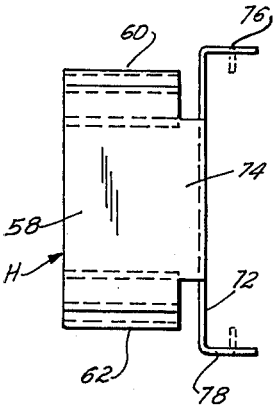
FIG. 3c
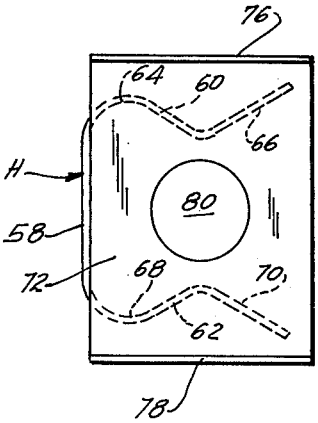
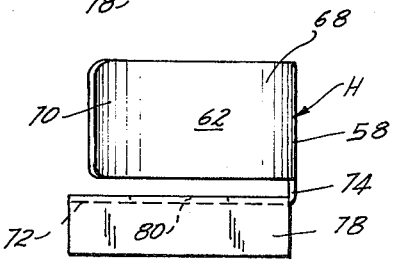
FIG. 3d

DETENT MECHANISM FOR MECHANICAL COUNTER HAVING PARTITION MEMBER

The present invention relates to counters which may be used as channel indicia display devices for television tuners and the like and, more particularly, to a detent means for use in such a counter for properly aligning the indicia on the counter wheels with a viewing station.

Mechanical counters of various types have been utilized in a variety of different applications to display indicia in accordance with the operation of the mechanism of which the counter forms a part. One application for such mechanical counters has been as channel indicia display devices in television receivers and the like. The use of counters as display devices has become increasingly desirable since television receivers have been required to include UHF reception capability in addition to the standard VHF reception capability. This additional reception capability has required the use of channel indicia devices having a display capacity sufficient to display indicia corresponding to the 70 UHF channels (and often the 12 VHF channels, as well). Mechanical counters having units and tens wheels have been found suitable for this purpose as they may be manufactured relatively inexpensively and require only a minimal amount of space within the receiver.

Mechanical counters of the type considered herein normally include a plurality of counter wheels having indicia situated sequentially along the periphery thereof. The number of counter sheels required depends upon the application. One wheel is provided for each decade of readout required. The counter wheels are positioned in alignment with a viewing station which may be a transparent window or opening in the counter housing. The viewing station is shaped such that only a single indicia on each of the counter wheels is visible at one time. The counter wheels within the counter are mechanically interconnected such that a rotation of the first wheel in sequence through a given rotational angle will cause a given rotation of the second counter wheel, etc. For example, each wheel may be provided with the numerals 0 through 9 at 36° intervals on the periphery thereof. Thus, a mechanical interconnection between the wheels will cause the second wheel to be indexed through a 36° angle for each 360° rotation of the first wheel. Thus, the numbers 00 through 99 can be displayed if two counter wheels are utilized. This is all that is normally required for a channel indicia device in a television receiver. However, it should be appreciated that for other applications as many counter wheels as is required may be provided.

In counters of this type, it is preferable from a functional and aesthetic point of view to have the indicia on each wheel properly aligned with the indicia on every other wheel after each rotation. In addition, it is desirable to have the set of visible indicia appropriately aligned with the viewing station. One method of accomplishing this result is through the use of a detent mechanism which normally includes a wheel, referred to as a detent wheel, which has alternating protrusions and recesses situated along the periphery thereof. Cooperating with the detent wheel is a spring loaded member, called a detent, which exerts a force on the periphery of the detent wheel such that after each rotation of the detent wheel the recess on the wheel nearest the detent is aligned with the detent by causing the detent to come to rest at the lowest point in that recess. The detent wheel is connected to the counter wheel. If the numbers on the counter wheel are situated such that they will align with the viewing station when the lowest point of each recess on the detent wheel is aligned with the detent, then after each rotation of the counter wheel the appropriate numeral will be properly aligned with the viewing station.

It is, of course, possible to provide a separate detent mechanism for each counter wheel in the counter. However, this is an expensive and space-consuming method of accomplishing this function, especially in view of the fact that the counter wheels are mechanically interconnected. Even if a single mechanism is utilized, the addition of this component to the counter normally requires the use of additional mechanical parts which add to the expense of the counter and which also add to the space which is required for the counter. Since the manufacture of TV tuners in a highly competitive business from the standpoints of cost, reliability, and size, any increase in the cost of the tuner, although only in the order of a few cents, any reduction in the reliability of the mechanism or increase in the size thereof puts the tuner manufacturer at a substantial disadvantage with respect to its competitors.

Certain mechanical counters which have been used as channel indicia display devices have incorporated a partition member situated within the counter housing between the counter wheels. This partition member performs multiple functions, including providing a mounting for a portion of the mask for the viewing station and a mounting for the mechanism which interconnects the counter wheels. These type of counters, however, have not previously incorporated a detent mechanism therein, probably because such a detent mechanism would have been external to the counter wheels thus appreciably increasing the size of these counters as well as requiring additional parts and methods to mount these additional parts to the counter housing.

It is, therefore, the prime object of the present invention to provide a detent mechanism for a mechanical counter having a partition member which is formed of inexpensive and easily mounted parts designed to perform reliably throughout the life of the counter.

It is another object of the present invention to provide a detent mechanism for a mechanical counter having a partition member which may be received within a recess in the counter wheel in a manner such that the additional space required by the detent mechanism is minimized.

It is a further object of the present invention to provide a detent mechanism for a mechanical counter having a partition member wherein the detent member is mounted to the partition member.

In accordance with the present invention, a mechanical counter is provided including a housing having a viewing station, a mask having an opening therein located at the viewing station is preferably provided, and units and tens counter wheels are coaxially aligned within the housing in alignment with the viewing station and the mask if present. Means operably connecting the counter wheels to drive the tens counter wheel in accordance with the rotation of the units counter wheel is provided. A detent wheel is operably connected to the units counter wheel for rotation therewith. A partition member, which preferably carries the mask, is situated between the counter wheels, and the detent member in the form of spring means is mounted on the partition member so as to cooperate with the detent wheel to position the units wheel relative to the viewing station after each rotation thereof.

The spring means has a substantially U-shaped cross-section such that it circumferentially surrounds a substantial portion of the periphery of the detent wheel. The spring means comprises a base member and a pair of leg members, one of which is situated on each end of the base member. Each of the leg members has first and second parts joined at an obtuse angle so as to form a protrusion. The legs extend in the same direction from the base member, and the protrusions are spaced to receive the detent wheel therebetween. Preferably, the protrusions are diametrically opposed such that they exert forces on the detent wheel in opposite directions.

The spring means further includes a mounting member connected to the base member which has means thereon for mounting the spring means to the partition member. These mounting means may comprise a pair of mounting arms, each of which has a portion thereof which is spaced from the mounting member and which is bendable in a substantially parallel relationship with the mounting member so as to form a space into which the partition member may extend.

To the accomplishment of the above and to such other objects as may hereinafter appear, the present invention relates to detent mechanisms for a mechanical counter having a partition member as defined in the appended claims and as described in the specification, taken together with the accompanying drawings in which:

FIG. 1 is a side cross-sectional view of the counter of the present invention;

Figure 4:
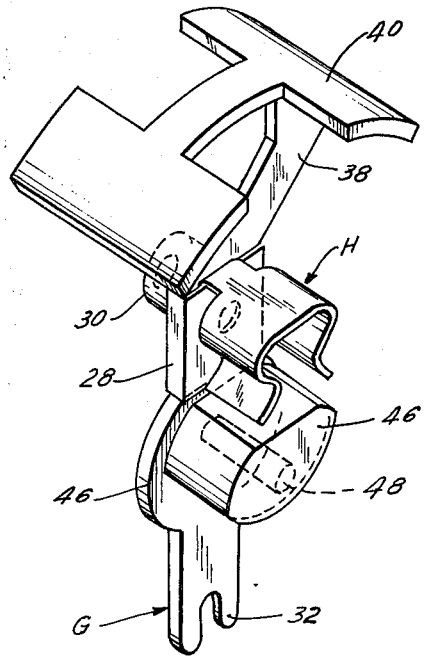
Figure 5:
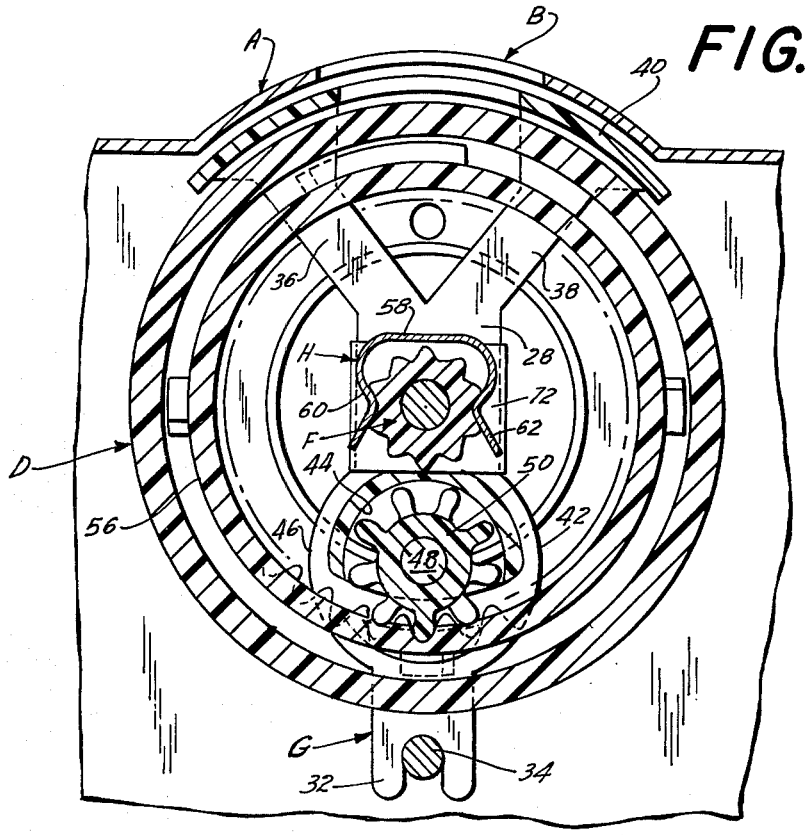

FIGS. 3*a*, 3*b*, 3*c*, and 3*d* are respectively elevational views of the front, top, rear, and side of the spring means of the present invention;

FIG. 4 is a perspective view of the partition member of the present invention showing the spring means mounted thereon; and FIG. 5 is a view of the present invention taken along line 5—5 of FIG. 1.

The counter of the present invention includes a housing, generally designated A, which has an opening therein, generally designated B, defining a viewing station. Housing A may form a portion of the receiver housing or may be a separate housing which is mounted to the receiver housing. First and second counter wheels, respectively designated C and D, are coaxially aligned and rotatably mounted within housing A with the peripheral edges thereof in alignment with opening B. The peripheral edges of counter wheels C and D have indicia thereon in the form of numerals 0 through 9. Means, generally designated E, are provided for operably connecting the first counter wheel and the second counter wheel to drive the second counter wheel in accordance with the rotation of the first counter wheel. A detent wheel, generally designated F, is operably connected to the first counter wheel C for rotation therewith. A partition member, generally designated G, is situated within the housing between counter wheels C and D. Spring means, generally designated H, is mounted to partition member G and cooperates with detent wheel F to position the counter wheel C relative to the viewing station in the well-known detent fashion after each rotation of the counter wheel.

Counter wheel C is fixedly mounted to a rotatable shaft 10 which extends outside of housing A and either end thereof. One end of shaft 10 extends outside of housing A to the exterior of the tuner and has mounted thereon the channel selector knob 12 for the receiver. The other end of shaft A extends beyond a mounting plate 14 to the interior of the receiver and is operably connected to the tuner drive mechanism (not shown). The rotation of tuner knob 12 causes an indexing of the counter and simultaneously drives the tuner drive mechanism to condition the tuner to select the appropriate channel. The second counter wheel D is freely rotatable on shaft 10 and thus does not necessarily rotate with the rotation of shaft 10.

Counter wheels C and D are preferably made of one piece of molded plastic and have cylindrical coaxial rims 16 and 18 respectively, of the same diameter and axial width. Each wheel rim preferably bears a 0 to 9 indicia sequence on its peripheral cylindrical surface with an equiangular centerline spacing of 36° between indicia. To facilitate reading the counter wheels under reduced lighting, backlighting is provided by an incandescent lamp 20 which may be connected to be energized when the TV receiver is turned on. Counter wheels C and D have axially spaced central hubs 22 and 24 respectively, for supporting counter wheels on shaft 10. Shaft 10 has a knurled section 26 for securing hub 22 of counter wheel C to the shaft.

Figure 2:
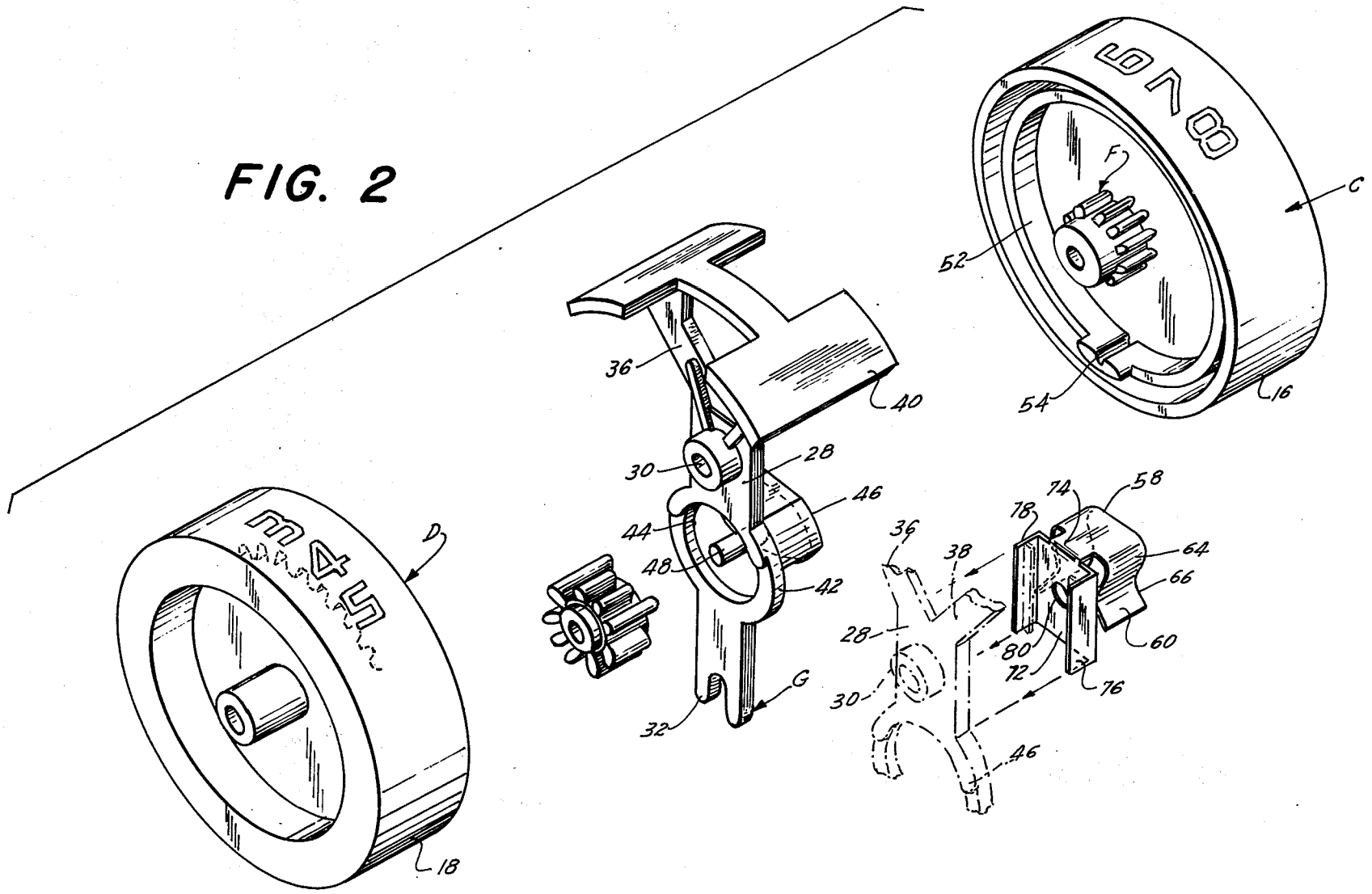
FIG. 2 is an exploded isometric view of the units and tens wheels, the partition member, and the detent mechanism of the present invention.

As best seen in FIG. 2, partition member G comprises a generally elongated body portion 28 with a protruding hub portion 30 having an aperture therein through which shaft 10 extends. On the extreme bottom portion of partition member G is a slotted or bifurcated end 32 which extends beyond the perimeter of the counter wheels C and D about a fixed rod 34 for anchoring member G against rotation about shaft 10. The top portion of body 28 has protruding therefrom a pair of arms 36, 38 upon which is mounted a mask portion 40, generally in the shape of an I formed on a convex surface. Mask portion 40 aligns with opening B and the recesses therein permit the visibility of a single one of the indicia on each of the wheels C and D in each of the openings on either side of the vertical portion of the I. The intermediate portion of elongated body 28 has a circular section 42 with a circular opening 44 therein. Laterally extending from circular portion 42 is a member 46 which has a substantially semicircular shape having the bottom thereof opened. Mounted on member 46 is a shaft 48 upon which a pinion 50 is rotatably mounted. Pinion 50 has a number of protrusions mounted along the periphery thereof, some of which are longer than others, for reasons set forth below.

As can be seen in FIG. 2, situated within rim 16 of counter wheel C is another rim 52 having a recessed portion 54 thereon. A similar rim 56 is situated within rim 18 on counter wheel D in a manner identical to that shown in FIG. 2 for rim 54. However, rim 56 has recesses (not shown) situated along its entire surface. Some of the protrusions on pinion 50 extend along the entire width of the pinion while others extend over a length less than the entire width of pinion 50. Counter wheel C is spaced with respect to pinion 50 such that recess 54 will only engage those protrusions on pinion 50 which extend along the entire width thereof. Pinion 50 will be indexed a single time through a specific rotational angle each time counter wheel C is moved through a 360° rotation. Each of the protrusions on pinion 50 are shaped to engage the recesses on rim 56 of counter wheel D such that each time pinion 50 is indexed, counter wheel D will be rotated 36°. Thus, pinion 50 forms the operable connection between counter wheels C and D, and provides a 36° rotation of counter wheel D for each 360° rotation of counter wheel C.

As can be seen from FIGS. 3*a*, 3*b*, 3*c*, and 3*d*, spring means H comprises a base member 58 and a pair of leg members 60 and 62, respectively. Leg member 60 is connected to one end of base member 58, and leg member 62 is connected to the other end of base member 58. Both leg members 60 and 62 extend in the same general direction relative to base member 58 and thereby form a member having a generally U-shaped cross-section. Leg member 60 has a first part 64 bent inwardly and a second part 66 bent outwardly which join at an obtuse angle. In a similar manner, leg member 62 has a first part 68 bent inwardly and a second part 70 bent outwardly which join at an obtuse angle. The first part and the second part each of the leg members, because they are joined at an obtuse angle, form a protrusion. These protrusions face in opposite directions towards each other and are spaced apart such that the detent wheel F can be received therebetween.

A mounting member 72 is connected to base member 58 by a portion 74 of base member 58 which extends beyond the width of leg members 60 and 62. Mounting member 72 is substantially perpendicular to base member 58 and extends from base member 58 in the same direction as do leg members 60 and 62. Because portion 74 of base member 58 extends beyond leg members 60 and 62, mounting member 72 is spaced a small distance from leg members 60 and 62, as shown in FIGS. 3*b* and 3*d*. Mounting member 72 is provided with a pair of mounting arms 76, 78, one of which is mounted on each end of mounting member 72. Mounting arms 76 and 78 are substantially perpendicular to mounting member 72 and extend in the direction opposite to the direction of extension of legs 60 and 62. A portion of each of the mounting arms 76 and 78 spaced from mounting member 72 is bendable to a position which is substantially parallel to mounting member 72 but spaced therefrom. The bent position is shown in phantom in FIGS. 3*b* and 2. Once bent, mounting arms 76 and 78 form a space into which the elongated portion 28 of partition member G may extend such that spring means H may be fixedly mounted on partition member G, as shown in FIG. 2. It should be noted that mounting member 72 has an aperture 80 therein which aligns with the opening in hub 30 such that shaft 10 may extend therethrough.

The base member 58 and leg members 60 and 62 of spring means H are shaped to circumferentially surround a substantial portion of the periphery of detent wheel F. Detent wheel F has situated around the periphery thereof alternating protrusions and recesses. As shown in FIG. 5, detent wheel F fits within the interior of the recess formed by base member 58 and leg members 60 and 62 such that the protrusions formed by legs 60 and 62 cooperate with the periphery of detent wheel F in the well-known detent fashion by each exerting a force on the periphery of detent wheel F. The forces exerted on the periphery of detent wheel F by the protrusions on legs 60 and 62 tend to cause detent wheel F to rotate such that the protrusions on leg portions 60 and 62 cause the recess closest to each of these protrusions to line up with the protrusion at the end of each rotation of the wheel. Detent wheel F is so positioned with respect to counter wheel C such that when the recesses thereon are aligned with the protrusions on leg members 60 and 62 respectively, the appropriate indicia on rim 16 is aligned with the recess in mask H. Thus, after each rotation of counter wheel C, detent wheel F is detented by the protrusions on leg members 60 and 62 such that the appropriate indicia on rim 16 is aligned with the recess in mask 40.

Preferably, the protrusions formed by leg members 60 and 62 respectively, are diametrically opposed such that they exert forces in opposite directions on detent wheel F. In this manner, the amount of force required to retain spring means H is the proper position with respect to detent wheel F and partition member G is minimal. In addition, it should be noted that rims 16 and 54, and detent wheel F, all extend from the side of detent wheel C in the same direction and for approximately the same distance. Thus, a recess is formed by detent wheel D, the side of counter wheel C, and rim 54 into which spring means H is at least partially received. Thus, the utilization of spring means H requires substantially no extra space and does not appreciably add to the volume of the counter.

It should therefore be appreciated that the present invention comprises detent mechanisms for a mechanical counter having a partition member which consists of a spring means which may constitute a single piece of stamped or molded material formed into the necessary shape and a standard detent wheel. The spring means may be mounted to a partition member in a single, simple operation during assembly and thus installed in the counter at minimal expense. In addition, the spring member is so shaped such that it cooperates with the detent wheel by imposing diametrically opposed forces thereon, thereby eliminating the application of any bending moment on the partition member such that no appreciable force is exerted on the partition member during rotation of the detent wheel. As a result, the spring means may be mounted to the partition member in a simple, inexpensive manner. Moreover, the spring member is received within a recess formed in the counter wheel between the hub and the rim, and thus does not appreciably add to the amount of volume which the counter requires. Because of the interconnnection between the detent wheels, a single detent mechanism is utilized to detent both counter wheels. This detent function is performed by simple, inexpensive parts which reliably interact and which are simply and inexpensively installed in a manner which does not increase the overall volume of the counter.

While but a single preferred embodiment of the present invention has been herein specifically disclosed for purposes of illustration, it is apparent that many variations and modifications may be made upon the specific method disclosed herein. It is intended to cover all of these variations and modifications which fall within the scope of this invention as defined by the appended claims.

I claim:

1. A counter comprising a housing having a viewing station, first and second counter wheels rotatably mounted on said housing in alignment with said viewing station, means operably connecting said counter wheels to drive said second counter wheel in accordance with the rotation of said first counter wheel, a detent wheel operably connected to said first counter wheel for rotation therewith, a partition member situated between said counter wheels, and spring means mounted on said partition member and cooperating with said detent wheel to position said first counter wheel relative to said viewing station after each rotation thereof.

2. The counter of claim 1 wherein said spring means comprises a base member and a pair of leg members extending from spaced points on said base member, each of said leg members having a protrusion formed thereon, said leg members extending in the same direction from said base member and said detent wheel being received between and engaged by said protrusions.

3. The counter of claim 1 wherein said spring means circumferentially surrounds a substantial portion of the periphery of said detent wheel.

4. The counter of claim 1 wherein said spring means has a pair of protrusions thereon situated in diametrically opposed relationship and extending toward each other.

5. The counter of claim 1 wherein said spring means has a substantially U-shaped cross-section.

6. The counter of claim 1 wherein said detent wheel is coaxially aligned with said first counter wheel and mounted to the side thereof, said first counter wheel having an axially extending rim spaced from said detent wheel and forming a recess therebetween, said spring means being at least partially received within said recess.

7. The counter of claim 1 further comprising a mask, said mask being mounted on said partition member in alignment with said viewing station.

8. The counter of claim 2 wherein said spring means further comprises a mounting member connected to said base member and situated substantially perpendicular thereto, said mounting member having means thereon for mounting said spring means to said partition member.

9. The counter of claim 8 wherein said mounting means comprise a pair of mounting arms which extend from spaced points on said mounting member in substantially perpendicular relationship thereto.

10. The counter wheel of claim 3 wherein said mounting member extends from said base member in the same direction as said leg members.

11. The counter of claim 10 wherein said mounting member is spaced from said leg members.

12. The counter of claim 9 wherein each of said arms has a portion spaced from said mounting member which is bendable in substantially parallel relationship with said mounting member so as to form a space therebetween into which said partition member may extend.

13. The counter of claim 7 wherein said spring means comprises a base member and a pair of leg members extending from spaced points on said base member, each of said leg members having a protrusion formed thereon, said leg members extending in the same direction from said base member and said detent wheel being received between and engaged by said protrusions.

14. The counter of claim 13 wherein said spring means further comprises a mounting member connected to said base member and situated substantially perpendicular thereto, said mounting member having means thereon for mounting said spring means to said partition member.

15. A counter comprising a housing having a viewing station, lower order and higher order counter wheels rotatably mounted on said housing in alignment with said viewing station, means operatively connecting said counter wheels to drive said higher order counter wheel in accordance with the rotation of said lower order counter wheel, a detent wheel separate from said means, operatively connected to said lower order counter wheel for rotation therewith, a partition member situated between said counter wheels, and spring means mounted on said partition member and cooperating with said detent wheel to position said lower order counter wheel relative to said viewing station after each rotation thereof.

16. The counter of claim 15 further comprising a mask, said mask being mounted on said partition member in alignment with said viewing station.

17. The counter of claim 16 wherein said spring means comprises a base member and a pair of leg members extending from spaced points on said base member, each of said leg members having a protrusion formed thereon, said leg members extending in the same direction from said base member and said detent wheel being received between and engaged by said protrusions.

18. The counter of claim 17 wherein said spring means further comprises a mounting member connected to said base member and situated substantially parallel thereto, said mounting member having means thereon for mounting said spring means to said partition member.

* * * * *